US006497349B1

(12) United States Patent
Ramirez

(10) Patent No.: US 6,497,349 B1
(45) Date of Patent: Dec. 24, 2002

(54) SUPPORT DEVICE FOR AN ELONGATED WEAPON

(76) Inventor: Leonard C. Ramirez, 2237 E. Leland Rd., Suite 180, Pittsburg, CA (US) 94565

( * ) Notice: Subject to any disclaimer, the term of this patent is extended or adjusted under 35 U.S.C. 154(b) by 0 days.

(21) Appl. No.: 09/813,061

(22) Filed: Mar. 20, 2001

Related U.S. Application Data

(63) Continuation-in-part of application No. 09/641,598, filed on Aug. 18, 2000, now abandoned.

(51) Int. Cl.[7] ..... B65D 25/04

(52) U.S. Cl. ..... 224/245; 224/200; 224/674; 224/914; 224/915

(58) Field of Search ..... 224/197, 199, 224/200, 671, 674, 242, 243, 245, 914, 915

(56) References Cited

U.S. PATENT DOCUMENTS 755,009 A * 3/1904 Igel ..... 224/250
1,894,540 A * 1/1933 Peirce ..... 224/242
2,956,715 A * 10/1960 Henderson ..... 224/245
3,384,277 A * 5/1968 Hodelka ..... 224/242
3,700,147 A * 10/1972 Vaughn ..... 224/149
4,588,116 A * 5/1986 Litman ..... 224/672
4,830,247 A * 5/1989 Banks ..... 211/70.6
4,951,857 A * 8/1990 Carr ..... 211/65
4,955,518 A * 9/1990 Parsons et al. ..... 224/247
5,232,137 A * 8/1993 Devine ..... 222/175
5,803,325 A * 9/1998 Wang ..... 224/275

* cited by examiner

*Primary Examiner*—Stephen K. Cronin
(74) *Attorney, Agent, or Firm*—Theodore J. Bielen, Jr.

(57) ABSTRACT

A support device for an elongated weapon which is connectable to a belt. The support includes a housing having a bottom and a wall portion extending from the bottom along the dimension of elongation of the weapon. The wall portion forms an open chamber for accommodating the weapon and positioning the elongated weapon in an upright manner with the weapon resting on the bottom of the housing. A clamp releasably secures a portion of the elongated weapon in the upright manner, but is removed with a force applied outwardly from the housing. A slot is formed in the wall portion and extends along the majority of the dimension of elongation of the weapon.

5 Claims, 6 Drawing Sheets

SUPPORT DEVICE FOR AN ELONGATED WEAPON

CROSS-REFERENCES TO RELATED APPLICATIONS

The present application is a Continuation-in-Part of U.S. patent application Ser. No. 09/641,598, filed Aug. 18, 2000, now abandoned.

BACKGROUND OF THE INVENTION

The present invention relates to a novel and useful support or holster for an elongated weapon.

Police and security forces are often required to carry weapons such as batons or nightsticks in the line of duty. These elongated weapons are normally carried in a sheath or loop connected to a belt which surrounds the peace officer. In certain cases, loops or tabs hold the weapon in the sheath or holster to prevent the same from being freed unexpectedly when the peace officer is moving.

One such weapon is found in U.S. Pat. No. 5,454,656 depicts an elongated type weapon which is typically used by enforcement personnel.

In the past, sheaths and holsters, although satisfactory in holding elongated type weapons, often prevent the immediate access to such weapons when needed. That is to say, elongated weapons such as Yawara sticks, nightsticks, batons, and the like must be drawn to the ready in immediate fashion.

The device for storing and permitting ready access to an elongated weapon would be a notable advance in the law-enforcing field.

BRIEF SUMMARY OF THE INVENTION

In accordance with the present invention a novel and useful support device for an elongated weapon is herein provided.

The support device of the present invention utilizes a housing having a bottom and a wall portion which extends from the bottom. The housing is shaped such that the wall portion follows the dimension of elongation of the elongated weapon. In this manner, the wall portion forms an open chamber for accommodating the elongated weapon permitting positioning of the weapon in an upright manner. The weapon rests on the bottom of the housing within the chamber of the housing. The housing may be manufactured of any suitable material such as plastic, metal, wood, composite compounds, and the like.

A slot is formed in the wall portion of the housing and extends along most of or a majority of the dimension of elongation of the elongated weapon in order to permit removal of the weapon from the housing. In other words, when the weapon is drawn or removed, it passes through the slot in the wall portion of the housing. The slot may include a shortened wall portion or may extend directly to the bottom of the housing. Also, the slot may be oriented such that a force away from the belt or the user of the weapon must be applied to a certain degree in order to remove the weapon. Such force would be in contrast to a tangent force. The slot, of course, would be oriented such that it faces outwardly from the belt or user of the weapon to a certain degree.

A clamp is also employed in the present invention for releasably securing a portion of the elongated weapon positioned in an upright manner within the housing. The clamp is capable of releasing the weapon for removal from the housing upon the application of prior mentioned force on the weapon outwardly from the housing. Again, when the slot is angled away from the belt or user, such force would have a component which vectors outwardly from the belt or from the user of the weapon.

A wall portion adjacent the slot is found in the embodiment of the invention, a lip may be formed to offer some support to the weapon, also, the wall portion adjacent the slot is formed as a continuation of the slot and may be skewed to further ease the removal of the weapon without resistance from the housing structure.

In addition to the structure of the device hereinabove described, a strap may be used to surround the weapon. Such strap may extend from the belt and include fastening means for releasably holding the same in such surrounding relationship relative to the weapon.

Moreover the structure of the device of the present application may include a sheath which is capable of supporting a baton or similar weapon. The support for the baton is provided by a rim of the sheath which engages an enlarged portion of the baton. Also, the sheath may include a clamp which releases the weapon upon the application of an outward force. The sheath is capable of pivoting to allow the person supporting the weapon to assume various positions such as standing, sitting, kneeling, and the like.

It may be apparent that a novel and useful support device for an elongated weapon has been hereinabove described.

It is therefore an object of the present invention to provide a support device for an elongated weapon which secures the weapon to the belt of a user and permits the quick release of the weapon for use.

Another object of the present invention is to provide a support device for an elongated weapon which includes a clamp mechanism that releases the weapon from a housing by the use of an outward force relative to the housing.

A further object of the present invention is to provide a support device for an elongated weapon which is compatible with weapon carrying paraphernalia normally used by law enforcement personnel.

Another object of the present invention is to provide a support device for an elongated weapon which is easily attachable to a belt employed by law enforcement personnel.

Another object of the present application is to provide a support device for a weapon which is capable of accommodating weapons of different sizes.

A further object of the present application is to provide a support device for a baton weapon which may be used with baton weapons of different configurations.

The invention possesses other objects and advantages especially as concerns particular characteristics and features thereof which will become apparent as the specification continues.

For a better understanding of the invention reference is made to the following detailed description of the preferred embodiments thereof which should be referenced to the prior described drawings.

DETAILED DESCRIPTION OF THE PREFERRED EMBODIMENTS OF THE INVENTION

Various aspects of the present invention will evolve from the following detailed description of the preferred embodiments which should be taken in conjunction with the hereinbefore-referenced drawings.

Figure 1:
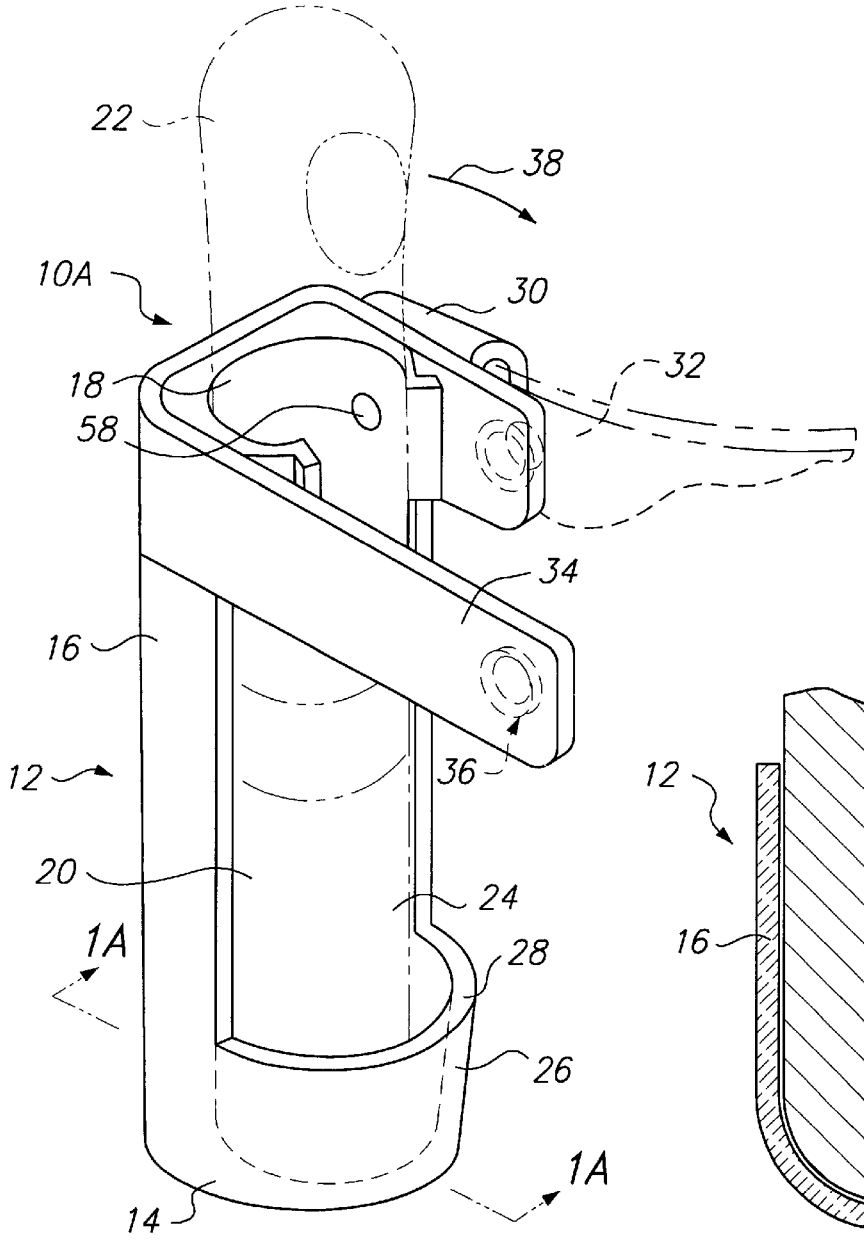
FIG. 1 is a top left side perspective view of an embodiment of the present invention in use with a belt and an elongated weapon shown in phantom.

The invention as a whole is shown in the drawings by reference character 10 and an upper case letter to denote various embodiments of the same. FIG. 1 shows embodiment 10A of the present invention where a housing 12 is depicted. Housing 12 includes a bottom 14 which is rounded. Wall portion 16 extends upwardly from bottom 14 and terminates in an upper opening 18. Housing wall portion 16 and bottom 14 forms an open chamber 20 for accommodating an elongated weapon 22 such as that depicted in U.S. Pat. No. 5,454,565. As shown in FIG. 1, weapon 22 is elongated and rests in an upright manner within chamber 20 of housing 2. Specifically, weapon 22 rests on bottom 14 of housing 12.

Figure 1A:
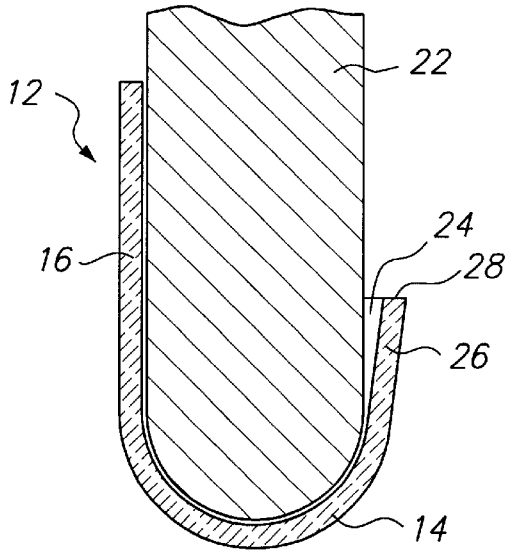
FIG. 1*a* is a sectional view taken along line 1*a*—1*a* of FIG. 1.

Housing 12 is constructed with a slot 24 formed in wall portion 16. Slot 24 extends along a majority of the dimension of elongated weapon 22. In the embodiment 10A depicted in FIG. 1, wall portion 16 possesses a shortened portion 26 having a lip 28 at its terminus. With reference to FIG. 1A, it may be observed that shortened portion 26 of wall portion 16 is skewed or angled outwardly when compared to the remaining part of wall portion 16. In this manner, weapon 22 is easily removed from chamber 24 of housing 12.

Returning to FIG. 1, it may be observed that device 10 includes a loop 30 which accommodates a belt or webbing 32 normally encircling the waist of the user. Strap 34 extends from loop 30 and belt 32 and encircles weapon 22 when closed. Fastening means 36 in the form of male and female snaps serves to releasably hold strap 34 in a surrounding relationship relative to weapon 22. Directional arrow 38 indicates the movement of the force which would be required to move weapon 22 from chamber 24 of housing 12 for use.

Figure 2:
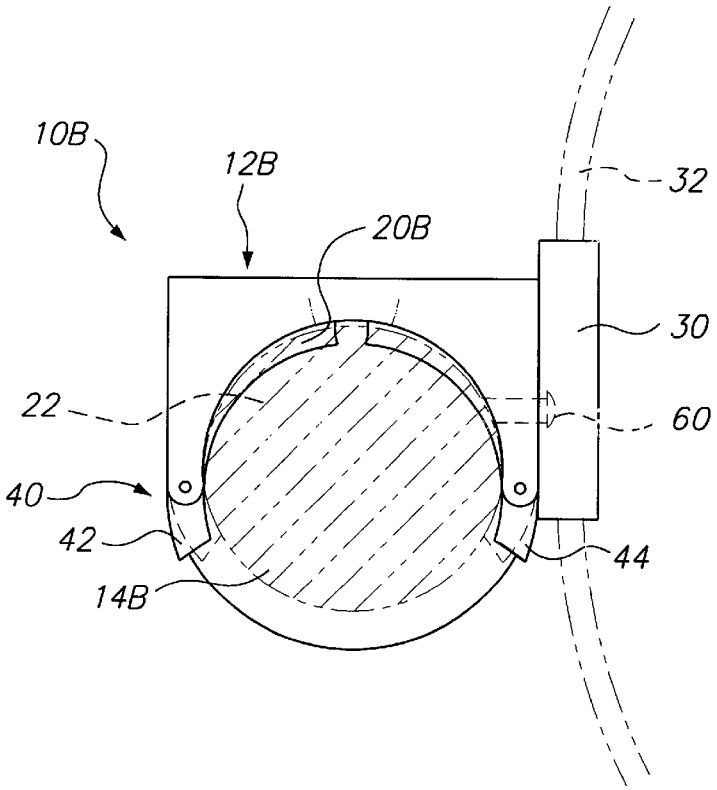
FIG. 2 is a top plan view of an embodiment of a clamp used in conjunction with a device of the present invention.
Figure 3:
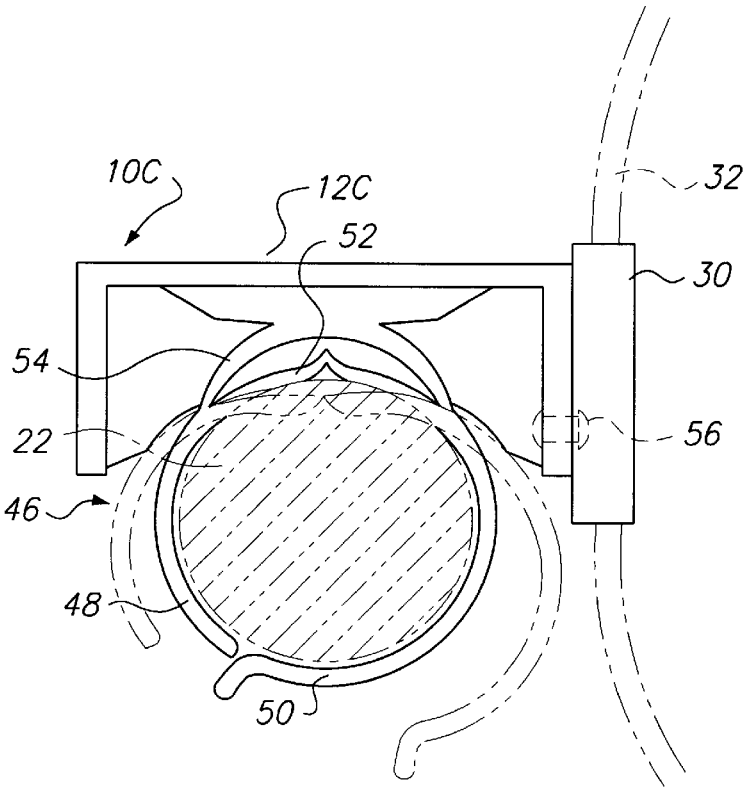
FIG. 3 is a top plan view of another clamp useable with the device of the present invention.

Turning to FIGS. 2 and 3, it may be observed that embodiments 10B and 10C are shown of the present invention. Embodiment 10B includes a housing 12B having a bottom 14B forming a chamber 20B. Weapon 22 is supported in an upright position as that shown in FIG. 1, but includes the addition of a clamp 40 to retain weapon 22 in such position. Clamp 40 includes a pair of jaws 42 and 44 but snap open when weapon 22 is pushed away from housing 12B. Such clamp is commercially available and known in the art.

FIG. 3 shows a similar embodiment as that depicted in FIG. 2 except that a clamp 46 of a different configuration is employed. Clamp 46 includes arms 48 and 50 which are sprung open when weapon 22 is dislodged according to directional arrow 38 on FIG. 1. Arms 48 and 50 are connected to a flexible wishbone base 52 which itself is connected to a flexible yoke 54. Rivet 56 holds housing 12C to loop 30 as does rivet 58 with respect to embodiment 10A. Again, rivet 60 performs the same function with respect to embodiment 10B.

Figure 4:
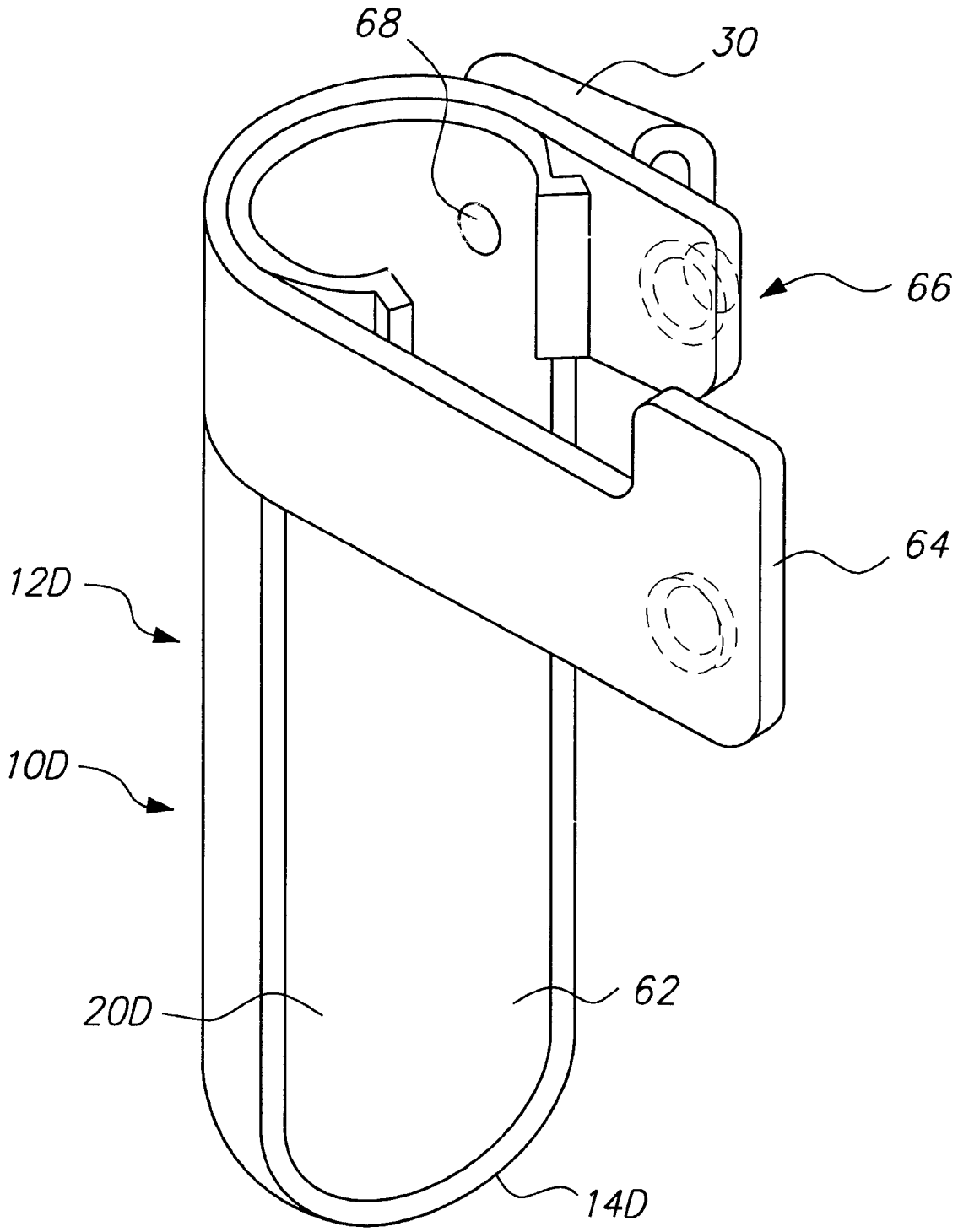
FIG. 4 is a top, left side, perspective view of another embodiment of the device of the present invention.

Turning now to FIG. 4, another embodiment 10D of the device of the present invention is shown. 10D includes a housing 12D having a bottom 14D slot 62 extends the entire length of housing 12, eliminating a shortened wall portion 26 of the type shown in embodiment 10A. Strap 64 again surrounds housing 12D and fastens in such surrounding relationship by the use of snap members 66. Rivet 68 holds housing 12D to loop 30. Thus, a weapon such as weapon 22 would be held in an upright position in a chamber 20D by strap 64.

Figure 5:
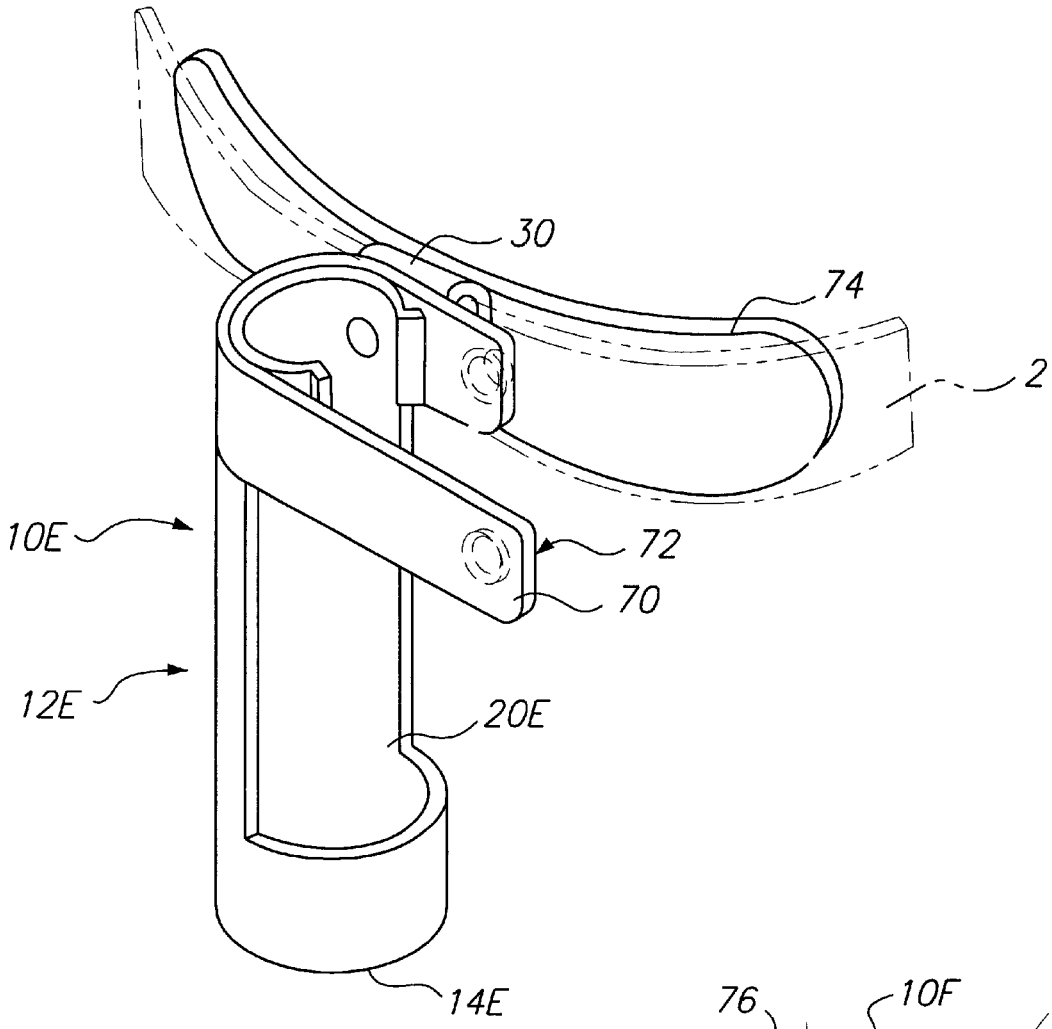
FIG. 5 is a top, left side, perspective view of a further embodiment of the present invention.

FIG. 5 shows embodiment 10E of the present invention in which a housing 12E includes a chamber 20E having a bottom 14E. strap 70 and snap member 72 releasably surround and hold a weapon such as weapon 22 placed in chamber 20E. Adjacent loop 32 a shield or partition 74 is placed which further supports device 10E behind belt 32.

Figure 6:
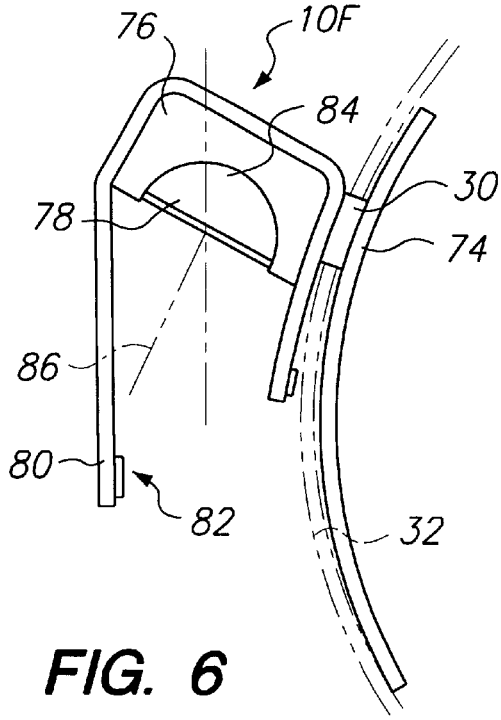
FIG. 6 is a top plan view of an embodiment of the present invention illustrating a skewed slot in the housing portion thereof.

Embodiment 10F of FIG. 6 is depicted in which a housing 76 is shown having a slot 78 that is oriented outwardly from belt 32. Strap 80 and snap fasteners 82 are intended to hold a weapon 22 in releasable fashion if weapon 22 were placed in chamber 84 of housing 76. The force required to remove weapon 22 from chamber 84 would lie along axis 86, which includes a component that extends outwardly from belt 32, in addition to the tangential force normally required with the prior embodiments.

Figure 7:
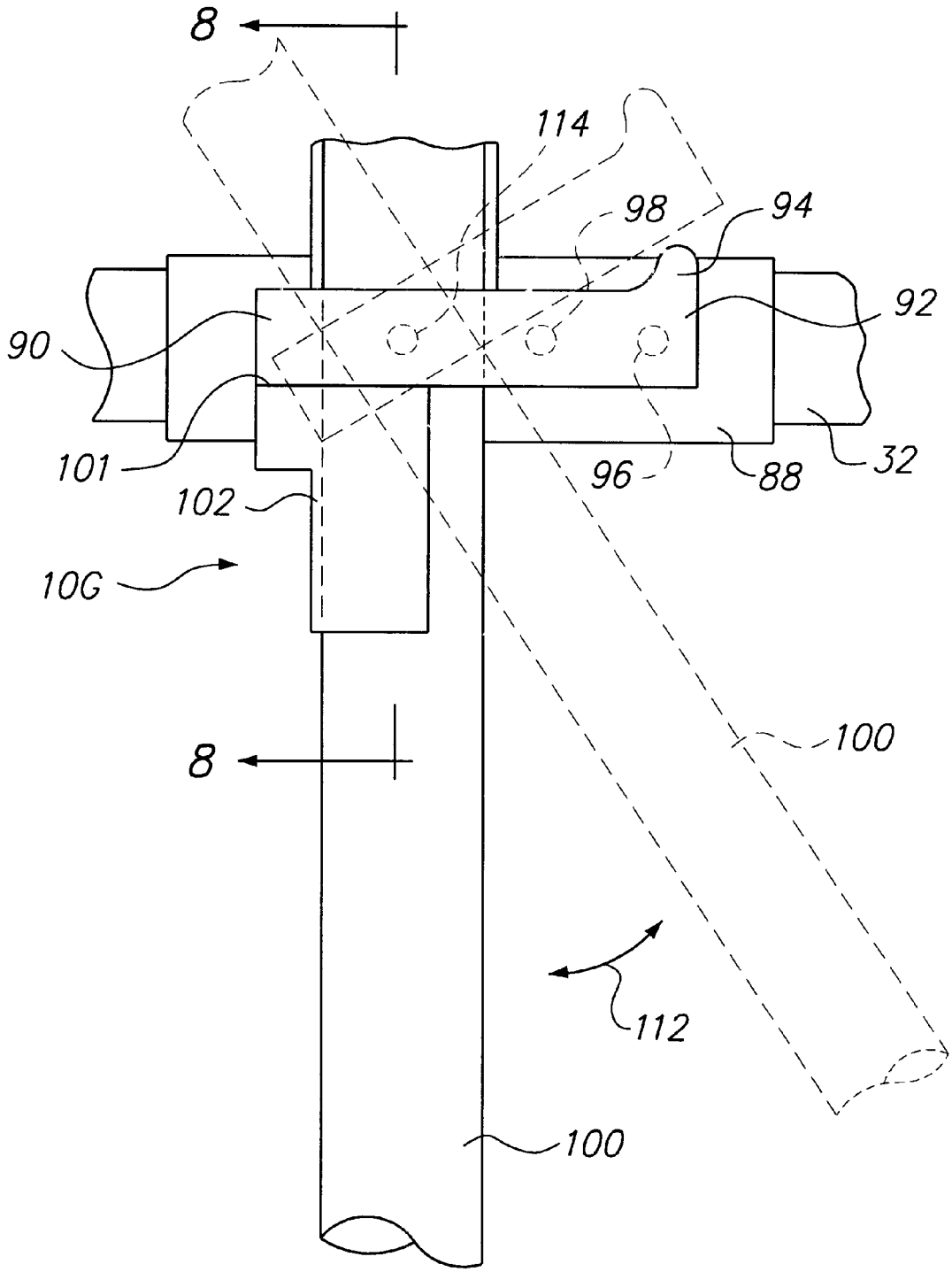
FIG. 7 is a side elevational view of another embodiment of the present application with a depiction of the rotational motion of the sheath.
Figure 8:
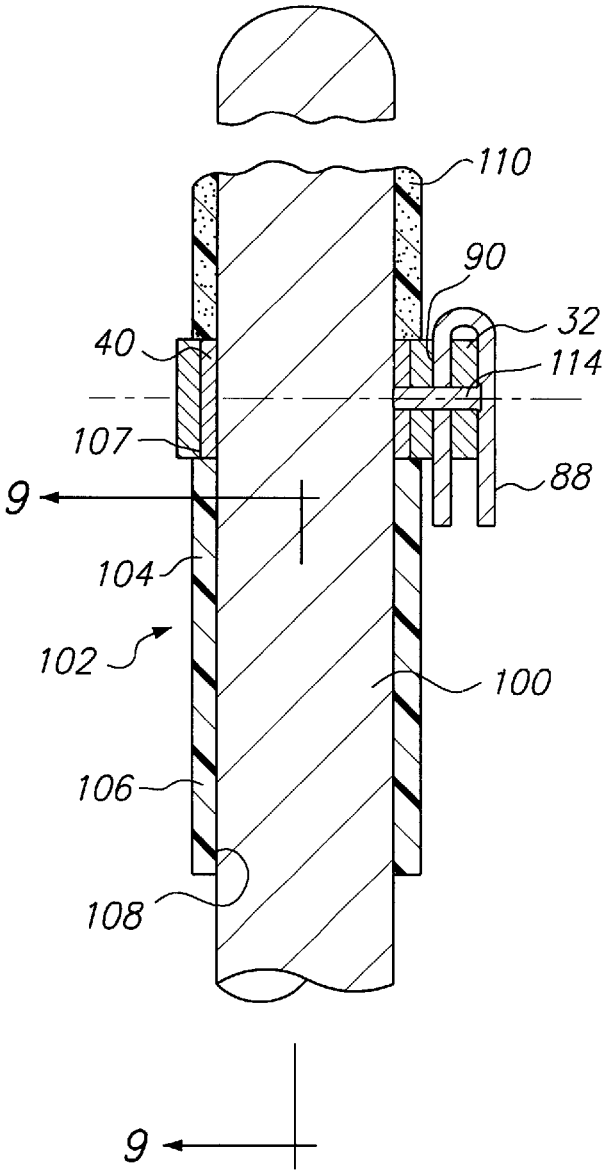
FIG. 8 is a sectional view taken along line 8—8 of FIG. 2.
Figure 9:
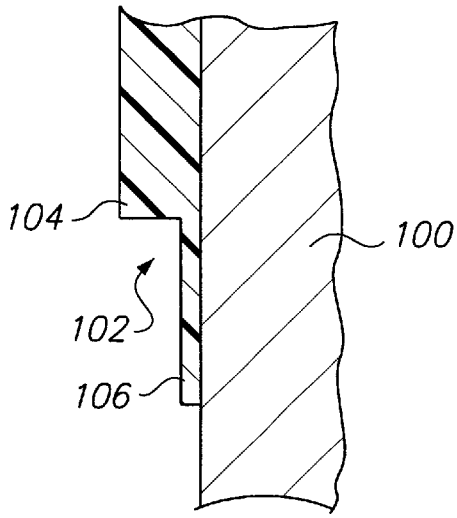
FIG. 9 is a sectional view taken along line 9—9 of FIG. 3.

With respect to FIGS. 7–9, embodiment 10G of the present invention is depicted. Embodiment 10G is used in conjunction with belt 32 of embodiments 10A–F. In addition, a hip support 88 loops over belt 32 as shown in FIGS. 7 and 8. It should be noted, that hip support 88 may include a closed aperture which would require the threading of belt 32 therethrough. Strap 90 lies against hip support 88 and includes a releasable end portion 92 having a thumb tab 94 to facilitate movement of the same. Snap mating pairs 96 and 98 are found on strap 90 in a manner similar to that depicted in FIG. 1 with respect to fastening means 36.

Support 10G is intended to be employed with elongated weapons of varying sizes, such as batons, nightsticks, collapsible batons, and the like. For example, full-length baton 100 is shown as being employed with support 10G. In this regard, support 10G includes a sheath 102. Sheath 102 possesses an upper portion 104 and a lower portion 106. Upper portion 104 and lower portion 106 of sheath 102 includes a common inner wall 108. Inner wall 108 is intended to at least partially rest against baton 100. Upper portion 104 is thicker in cross-sectional configuration than portion 106 to support clamp 40 and strap 90 against impact forces. It should be noted that clamp 40 rides on rim 107 of upper portion 104 of sheath 102, but may be constructed to lie within sheath 102 against an extension of inner wall 108. Baton 100 may be formed with a gripping member or grommet 110 such that the upper edges of clamp 40 and belt

90 would contact grommet 110 to gain additional support for baton 100 within sheath 102, in addition to that afforded by clamp 40.

Returning to FIG. 1, and viewing FIG. 8, it should be realized that baton 100 is capable of rotating according to directional arrow 112 such rotation is due to rivet 114 which extends through belt 32, hip support 88, strap 90, and clamp 40. Such rotation would allow the person using support 10G with a long baton 100 to assume other positions such as kneeling or sitting.

In operation, the user fastens any one of the devices 10A–10E to a belt 32 by the use of loop 30. Weapon 22 is placed in the chamber of any of the housings of any of the embodiments above described. For example, with respect to embodiment 10A weapon 22 is placed in chamber 20 of housing 12 to lie on bottom portion 14. Strap 34 releasably holds weapon 22 in an upright position by the interaction of snaps 36. To release and remove weapon 22, a force is applied along directional arrow 38 after strap 34 is unfastened. Slot 24 of housing 12, as well as the slots of the other embodiments, permits the easy removal of weapon 22 for use. It should be noted that embodiment 10E requires a slightly different force, somewhat outwardly, to remove weapon 22, because slot 28 is oriented slightly outwardly. Thus, the embodiments found in devices 10–10E support an elongated weapon in an upright position and allow the easy removal of the same by a forward or outward force, obviating the need for pulling the weapon from a sheath or loop found in the prior art.

While in the foregoing, embodiments of the present invention have been set forth in considerable detail for the purposes of making a complete disclosure of the invention, it may be apparent to those of skill in the art that numerous changes may be made in such details without departing from the spirit and principles of the invention.

What is claimed is:

1. A support apparatus for an elongated weapon the apparatus being connectable to a belt, comprising:

a. a sheath, said sheath having a wall portion forming a recess at last partially surrounding the elongated weapon, said wall portion terminating in a rim;

b. a clamp supported within said sheath, said clamp releasably securing a portion of the elongated weapon upon the application of a force on the weapon outwardly from said recess of said sheath;

c. means for supporting said sheath to belt; and d. means for rotating said apparatus relative to the belt.

2. The apparatus of claim 1 in which said sheath wall portion lies in contact with a portion of said elongated weapon.

3. The apparatus of claim 1 in which said sheath includes a first portion, said first portion including said rim and a second portion connected to said first portion.

4. The apparatus of claim 1 in which further comprises a strap fixed relative to said sheath, said clamp contacting said rim of said sheath.

5. The apparatus of claim 1 in which said sheath includes a first portion, said first portion including said rim and a second portion connected to said first portion.

* * * * *